US010530110B2

(12) United States Patent
Shelton et al.

(10) Patent No.: US 10,530,110 B2
(45) Date of Patent: Jan. 7, 2020

(54) METHODS OF PROVIDING A TEMPORARY ELECTRICAL GROUNDING SYSTEM HAVING A MAGNETIC COMPONENT COUPLED TO A CONDUCTIVE SURFACE

(71) Applicant: AMERICAN WATER WORKS COMPANY, INC., Voorhees, NJ (US)

(72) Inventors: Kevin Shelton, Birdsboro, PA (US); Kandis L. Moser, Sinking Spring, PA (US)

(73) Assignee: American Water Works Company, Inc., Camden, NJ (US)

( * ) Notice: Subject to any disclaimer, the term of this patent is extended or adjusted under 35 U.S.C. 154(b) by 296 days.

(21) Appl. No.: 15/473,997

(22) Filed: Mar. 30, 2017

(65) Prior Publication Data

US 2017/0207595 A1 Jul. 20, 2017

Related U.S. Application Data

(62) Division of application No. 14/960,836, filed on Dec. 7, 2015, now Pat. No. 9,647,351.

(60) Provisional application No. 62/098,765, filed on Dec. 31, 2014.

(51) Int. Cl.

| | |
|---|---|
| ***H01R 43/00*** | (2006.01) |
| ***H01R 43/26*** | (2006.01) |
| ***H01R 11/24*** | (2006.01) |
| ***H01R 11/30*** | (2006.01) |
| ***H01R 4/64*** | (2006.01) |
| ***H01B 13/00*** | (2006.01) |
| ***H01R 4/48*** | (2006.01) |

(52) U.S. Cl.
CPC ..... *H01R 43/26* (2013.01); *H01B 13/0036* (2013.01); *H01R 4/48* (2013.01); *H01R 4/64* (2013.01); *H01R 11/24* (2013.01); *H01R 11/30* (2013.01)

(58) Field of Classification Search
CPC . H01R 43/26; H01R 4/48; H01R 4/64; H01R 11/24; H01R 11/30; H01R 13/2428; H01B 13/0036; Y10T 29/49174
USPC ..... 29/257, 857; 439/38, 638
See application file for complete search history.

(56) References Cited

U.S. PATENT DOCUMENTS 6,659,800 B1 12/2003 Wu
7,467,948 B2 12/2008 Lindberg et al.
(Continued)

OTHER PUBLICATIONS

Notice of Allowance dated Jan. 3, 2017 in U.S. Appl. No. 14/960,836 in 9 pages.

(Continued)

*Primary Examiner* — Donghai D Nguyen
(74) *Attorney, Agent, or Firm* — BakerHostetler

(57) ABSTRACT

An apparatus for providing a temporary electrical grounding connection is described. The apparatus comprises a cable electrically joining first and second conductive couplings, the first and second conductive couplings each electrically coupled to a conductive surface using a clamp, magnetic component, or other connection component. A conductive coupling may be connected to the magnetic component using a clamp connected to a stub extending from the magnetic component, and there may be multiple clamps or magnetic components used in different combinations or series to provide an electrical bypass between two or more conductive surfaces.

13 Claims, 9 Drawing Sheets

(56) References Cited

U.S. PATENT DOCUMENTS

| | | | | |
|---|---|---|---|---|
| 7,500,882 | B2 * | 3/2009 | Goetz | H01R 13/2428 439/638 |
| 8,016,599 | B1 * | 9/2011 | Melby | H01R 11/30 439/38 |
| 9,135,478 | B2 | 9/2015 | Burns | |
| 2007/0072443 | A1 | 3/2007 | Rohrbach et al. | |
| 2009/0176383 | A1 | 7/2009 | Amotz et al. | |
| 2010/0285674 | A1 | 11/2010 | David et al. | |

OTHER PUBLICATIONS

Notice of Allowance dated Jan. 20, 2017 in U.S. Appl. No. 14/960,836, 4 pages.

* cited by examiner

METHODS OF PROVIDING A TEMPORARY ELECTRICAL GROUNDING SYSTEM HAVING A MAGNETIC COMPONENT COUPLED TO A CONDUCTIVE SURFACE

CROSS-REFERENCE TO RELATED APPLICATIONS

This application is a divisional application and claims priority to co-pending U.S. patent application Ser. No. 14/960,836, filed Dec. 7, 2015, titled "TEMPORARY ELECTRICAL GROUNDING SYSTEM HAVING A MAGNETIC COMPONENT COUPLED TO A CONDUCTIVE SURFACE," which claims priority to U.S. Provisional Patent Application No. 62/098,765, filed Dec. 31, 2014, titled "TEMPORARY ELECTRICAL GROUNDING DEVICE." The contents of each of these referenced applications are incorporated herein by reference in their entirety.

BACKGROUND

Municipal water distribution systems are designed to provide water from a central distribution facility to individual service locations. In these systems, water is often pumped through pipes buried in the ground. These pipes often require maintenance and repair due to age, damage, or other reasons. Repairing buried water pipes requires crewmen to excavate the pipes and disconnect and reconnect pipe connections. Some residential homes have electrical service that is grounded on the water pipes, which are often made of metal and therefore are electrically conductive. In these circumstances, there is occasionally stray electrical current passing through the pipes and the main distribution lines, as well as the junction between the two, a location known as a "curb stop." Service crews excavating pipes to repair, replace, or update them must handle the exposed metal pipes, and can be electrically shocked by the stray current traveling through the pipes. A new device that addresses these issues, among others, in therefore needed.

SUMMARY

A high-level overview of various aspects of the present invention is provided in this summary, as well as a selection of concepts that are further described below in the detailed-description section. This summary is not intended to identify key or essential features of the claimed subject matter, nor is it intended to be used as an aid in isolation to determine the scope of the claimed subject matter. The scope of the invention is defined by the claims.

In a first aspect, an apparatus for providing a temporary electrical grounding path is provided. The apparatus comprises an electrically conductive cable having first and second ends, a first conductive coupling electrically coupled to the first end of the cable and a first magnetic component, the first magnetic component detachably coupled to the first conductive coupling and configured to be electrically and magnetically coupled to a first conductive surface, and a second conductive coupling electrically coupled to the second end of the cable, the second conductive coupling configured to be electrically coupled to a second conductive surface.

In a second aspect, an apparatus for providing a temporary electrical bypass is provided. The apparatus comprises an electrically conductive cable having first and second ends, a first conductive coupling electrically coupled to the first end of the cable, the first conductive coupling configured to be electrically coupled to a first conductive surface, and a second conductive coupling electrically coupled to the second end of the cable, the second conductive coupling configured to be electrically coupled to a second conductive surface.

In a third aspect, a method for providing an electrical grounding connection is provided. The method comprises providing an electrically conductive cable having first and second ends, electrically coupling a first conductive coupling to the first end of the cable, electrically coupling a second conductive coupling to the second end of the cable, electrically coupling the first conductive coupling to a first conductive surface, and electrically coupling the second conductive coupling to a second conductive surface.

In this disclosure, the term "clamp" or "pipe clamp" as used herein may refer to any mechanical closing device that can couple an electrical component to a pipe or similar object and provide a secure connection. Such a device may be detachable or securable in a variety of ways. The clamps described herein are not limited to clamps designed for water pipes. The term "magnetic component" as used herein may comprise any number of magnetic devices configured to selectively attach and magnetically couple to a conductive surface.

BRIEF DESCRIPTION OF THE SEVERAL VIEWS OF THE DRAWINGS

Illustrative embodiments of the present invention are described in detail below with reference to the attached drawing figures. Although these figures are representative of a number of possible configurations of the temporary grounding apparatus, one of ordinary skill in the art would understand that multiple arrangements and combinations of the elements are possible, and the possible configurations of the apparatus are not limited to the examples shown in the drawings, which are exemplary and non-exclusive in nature. In reference to the figures.

DETAILED DESCRIPTION

Figure 1:
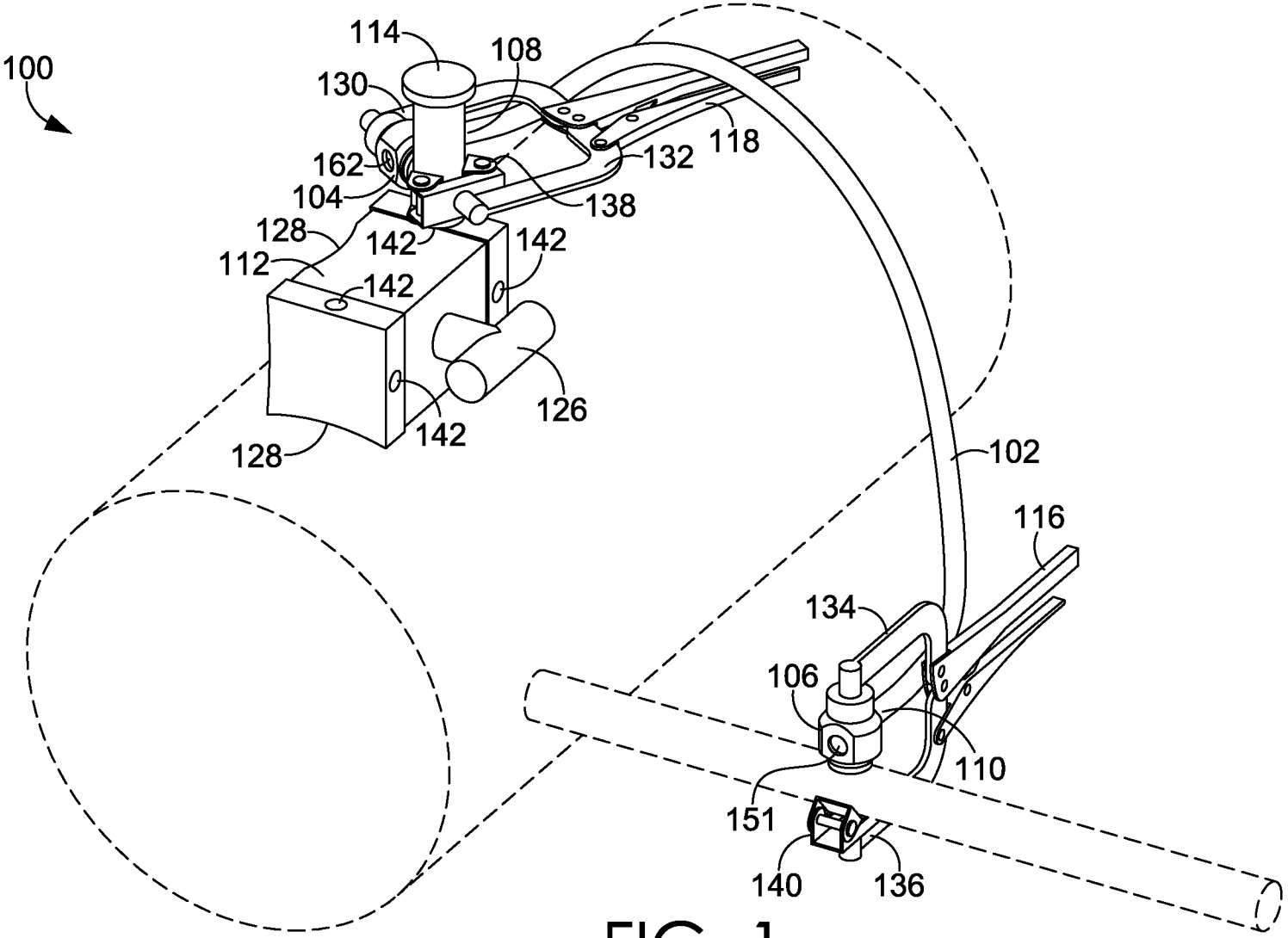
FIG. 1 is a perspective view of a first embodiment of a temporary electrical grounding apparatus, in accordance with an embodiment of the present invention.

The subject matter of the various embodiments of the present invention is described with specificity in this disclosure to meet statutory requirements. However, the description is not intended to limit the scope of claims. Rather, the claimed subject matter may be embodied in various other ways to include different features, components, elements, combinations, and steps, similar to the ones described in this document, and in conjunction with other present and future technologies. Terms should not be interpreted as implying any particular order among or between various steps disclosed herein unless the stated order of steps is explicitly required. Many different arrangements of the various components depicted, as well as use of components not shown, are possible without departing from the scope of the claims.

Aspects herein provide for an apparatus or device that is configured to provide a temporary electrical grounding connection between two conductive surfaces. Specifically, the apparatus or device may be configured to provide a temporary electrical grounding connection between pipes where ordinary electrical bypass equipment may be difficult to use or impractical. The device may comprise an electrically conductive cable having first and second ends, a first conductive coupling coupled to the first end of the cable, a second conductive coupling coupled to the second end of the cable, and a connection component electrically coupled to each conductive coupling. Each connection component may be configured to be coupled to a conductive surface, and the conductive surface may be exposed metal on a pipe. Each conductive coupling may be configured to attach to the respective conductive surface by a number of securement methods, including by the use of clamps, magnets, or a combination of the two.

In one exemplary aspect, the device comprises an electrically conductive cable having first and second ends, the first and second ends coupled to first and second conductive couplings, respectively. Each conductive coupling may be electrically coupled to a first or a second clamp configured to engage a conductive surface, such as a pipe, and provide electrical contact between the coupling and the conductive surface. The first clamp may engage a conductive surface on a first pipe and the second clamp may engage a conductive surface on a separate portion of the first pipe or on a second pipe, providing an electrical path between the conductive surfaces. Each clamp may be selected based on the size or type of the pipe. The clamp may be a C-type clamp, or a modified version of a C-type clamp, or another type of clamp.

Each clamp may be integrated with, secured to, or otherwise affixed to the first or the second conductive coupling in any number of ways to facilitate joining the conductive coupling to a pipe. The clamps may feature first and second halves, with the first half comprising the conductive coupling, and the second half comprising a securing component for holding the pipe against the conductive coupling when the clamp is closed around the pipe. The securement component may be a partial collar, saddle, coupling, or other component designed to engage and secure a pipe. The device may be selectively adjustable by securing the clamp to different locations, such as to different pipes or fittings, and in this regard, the orientation of the cable and mounts can be adjusted. This may be useful for creating a secure electrical connection in difficult to reach pipe configurations or geometries.

The clamps may be configured to engage and secure different valves or junctions on a pipe. The first and second halves of each clamp may comprise any number of connections, tools, objects, or shaped elements to facilitate such connections. Each clamp may be selectively interchangeable to allow use of different sized clamps with the conductive couplings, the different clamps suitable to engage and secure different sized pipes or pipes with different requirements for mechanical coupling (e.g., amount of closing force required to prevent damage to the pipe). Each clamp may be integrated with the conductive coupling, such that the clamp provides part or all of the conductive coupling, or such that the conductive coupling is detachable from the clamp. Any of the clamp and accompanying components may also be electrically insulated.

In another exemplary aspect, the device may comprise first and second conductive couplings that are electrically coupled to a clamp and a magnetic component, respectively, to provide two different means of attaching to conductive surfaces (any combination is possible and contemplated). In one such configuration, the clamp may be used to electrically couple the first conductive coupling to a first pipe element, and the magnetic component may be used to magnetically and electrically couple the second conductive coupling to a second pipe element or another object where using a clamp would be less practical or easy to execute. This provides numerous options for a user to position the bypass device on one or more pipes, surfaces, or components, and may reduce the difficulty of attaching a bypass component to a large pipe where a clamp cannot be easily attached.

The magnetic component may be coupled to the second conductive coupling in a variety of ways. For example, the magnetic component may further comprise a conductive mount, such as a copper or brass stub, extending from one of a plurality of locations on the magnetic component. The second conductive coupling or magnetic component may further comprise a clamp, which may be similar to the clamp used to electrically engage a pipe as described above, configured to close around the stub and electrically engage and secure the second conductive coupling to the stub, and subsequently, to the magnetic component. The magnetic component may further include multiple stubs positioned at multiple locations. The magnetic component may be configured such that each stub may be selectively affixed, or positioned, at one of the plurality of locations. By having multiple locations for one or more stubs to be secured on the magnetic component, the connection between the second conductive coupling and the magnetic component may be adjusted to provide a more favorable orientation for the user.

The magnetic component may further comprise different shapes, elements, or features that facilitate attachment to the second conductive surface. For example, when the second conductive surface is a large diameter pipe, the magnetic component may be shaped to engage the pipe, and include contours on one or more surfaces of the magnetic component so that the magnetic component conforms to the shape of the large diameter pipe. The magnetic component may comprise multiple contours each shaped to engage and conform to the same or different sized pipes. For example, the magnetic component may comprise a box shape having four sides, with three sides shaped to conform to three different pipe diameters or pipe diameter ranges. The first side may conform to a 4-8 inch diameter pipe, the second side may conform to a 10-12 inch diameter pipe, and the third side may conform to pipes 16 inches or larger in diameter, for example. Alternatively, different pipe matching contours may be located on the same side of the magnetic component in varying arrangements, with the different contours overlapping, adjacent, or contained partially or wholly within each other. A handle may be affixed to the magnetic component to facilitate positioning and movement of the magnetic component and the handle may be at least partially insulated. Each of the cable, the conductive couplings, the magnetic components, the handle, and the clamps may be at least partially electrically and/or thermally insulated to shield electrical current.

In another exemplary aspect, the first and the second conductive couplings may be electrically coupled to first and second magnetic components configured to magnetically and electrically couple the first and second conductive components to first and second conductive surfaces, respectively, providing a temporary electrical bypass with only magnetic attachments. Each magnetic component may comprise the elements described above or include other features. The conductive surfaces may be located on different pipes or on different portions of the same pipe. The magnetic components may each comprise at least one conductor mount, or stub, extending from one of a plurality of possible locations on the magnetic component, allowing a variety of orientations and positions for the conductive cable connecting the two magnetic components. Each conductive coupling may be joined to each magnetic component using a clamp and a stub, as described above, or by another type of connection. The magnetic components may be shaped to engage a pipe or multiple pipes, and may have multiple contours shaped to engage different pipe diameters, or pipe diameter ranges, as described above. The magnetic components may also incorporate mounting handles. Each of the cable, the conductive couplings, the magnetic components, and the handles may be at least partially electrically and/or thermally insulated to shield electrical current.

In another exemplary aspect, multiple conductive couplings and cables may be used to form a multi-component temporary electrical grounding apparatus or device for connecting three or more conductive surfaces. Multiple clamps, a combination of clamps and magnetic components, or multiple magnetic components may be selected interchangeably to allow a variety of connections between conductive surfaces. The clamps and magnetic components may incorporate the features and elements described above, and may be electrically coupled by multiple cables joining the three or more conductive couplings using the components described above.

In one exemplary configuration of the multi-component temporary electrical grounding device described above, a clamp and two magnetic components may be used to electrically couple three conductive surfaces. The clamp may comprise a first conductive coupling on a first half of the clamp and a saddle on a second half of the clamp, and the clamp may be secured to a conductive surface on a pipe of a size that the clamp may engage. The first conductive coupling may be electrically coupled to a second conductive coupling with a first conductive cable, and the second conductive coupling may be electrically coupled to a first magnetic component using a clamp and a stub as described above, the second magnetic component electrically and magnetically coupled to a second conductive surface. A second stub may be positioned on the first magnetic component to allow the first magnetic component to be electrically coupled to a second magnetic component using a second cable. The second cable may be electrically coupled to each of the magnetic components using the clamp and stub configuration described above. Each of the clamp, the first magnetic component, and the second magnetic component may be coupled to different conductive surfaces to provide an electrical current path between each of the conductive surfaces, which may be used to ground an electrified pipe. Different orientations of the cables are possible by moving the stub to different locations on each magnetic component, and different variations of the components described herein may be used, as well as different combinations of elements. This example is non-limiting, and different electrical bypass configurations utilizing three clamps, three magnetic components, or any other combination of clamps and magnetic components are possible. This configuration can be extended or repeated using clamps or magnetic components to electrically couple as many conductive surfaces as desired.

Referring to FIG. 1, a first embodiment 100 of a temporary electrical grounding apparatus is shown, in accordance with an aspect of the present invention. In FIG. 1, a first electrically conductive cable 102 having a first end 108 and a second end 110 is electrically coupled to a first conductive coupling 104 at the first end 108 and a second conductive coupling 106 at a second end 110. The first conductive coupling 104 is electrically coupled to a first magnetic component 112 using a magnet clamp 118 secured to a conductive mount 114 (i.e., a stub 114), the stub 114 being positioned on the first magnetic component 112 at one of a plurality of locations 142. The magnet clamp 118 further comprises a first half 130 and a second half 132 which are brought together when the magnet clamp 118 is closed to electrically couple and secure the magnet clamp 118 to the stub 114. The first half 130 of the magnet clamp 118 retains the first conductive coupling 104, and the second half 132 of the magnet clamp 118 retains a saddle 138, which work together to engage and retain the stub 114 when the magnet clamp 118 is closed. The first magnetic component 112 includes a curved contour 128 that matches the curved contour of the pipe. The second conductive coupling 106 comprises a pipe clamp 116, the pipe clamp 116 including a first half 134 and a second half 136. The first half 134 of the pipe clamp 116 retains the second conductive coupling 106 and the second half 136 of the pipe clamp 116 retains a pipe saddle 140. When the pipe clamp 116 is closed, the first and second halves 134 and 136 are brought together to engage and secure a pipe.

Figure 2:
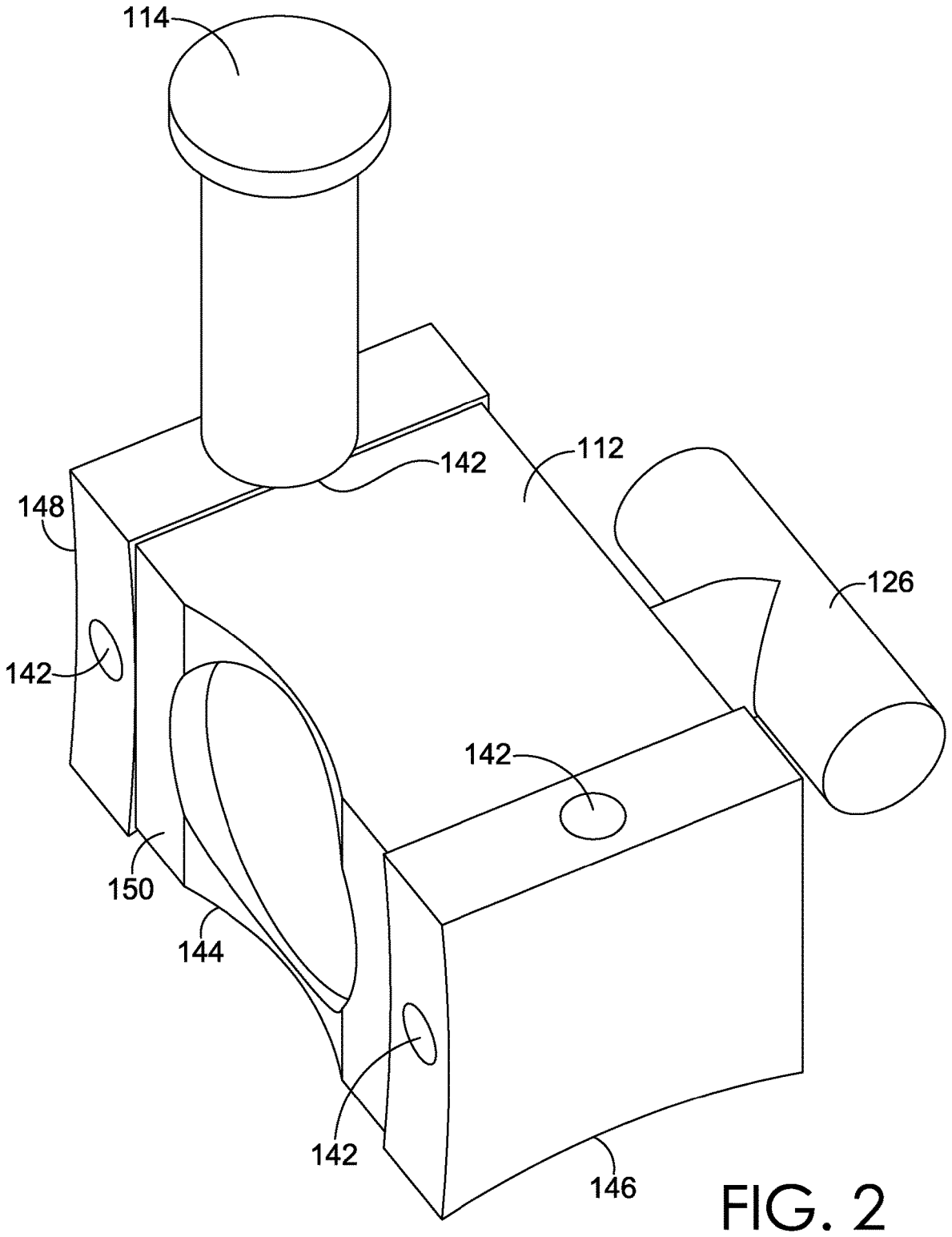
FIG. 2 is a perspective view of an exemplary magnetic component, in accordance with an embodiment of the present invention.

Referring to FIG. 2, the first magnetic component 112 is shown, in accordance with an aspect of the present invention. The first magnetic component 112 comprises a positioning handle 126 and a stub 114 positioned at one of a plurality of locations 142 on the first magnetic component 112. The first magnetic component 112 includes a first curved contour 144, a second curved contour 146, and third curved contour 148, the first curve contour 144 positioned within the third curved contour 148, the first and third curved contours 144, 148 being on a same side 150 of the magnetic component 112. The contours 144, 146, and 148 are configured to engage different sized pipes or different pipe diameter ranges (e.g., 4-8 inch, 10-12 inch, 16+ inches, respectively). One contour may be minimally curved or substantially flat to engage the side of a large diameter pipe. Any number of contours or flat sides may be selected for the magnetic component 112, based on the desired connection flexibility.

Figure 3:
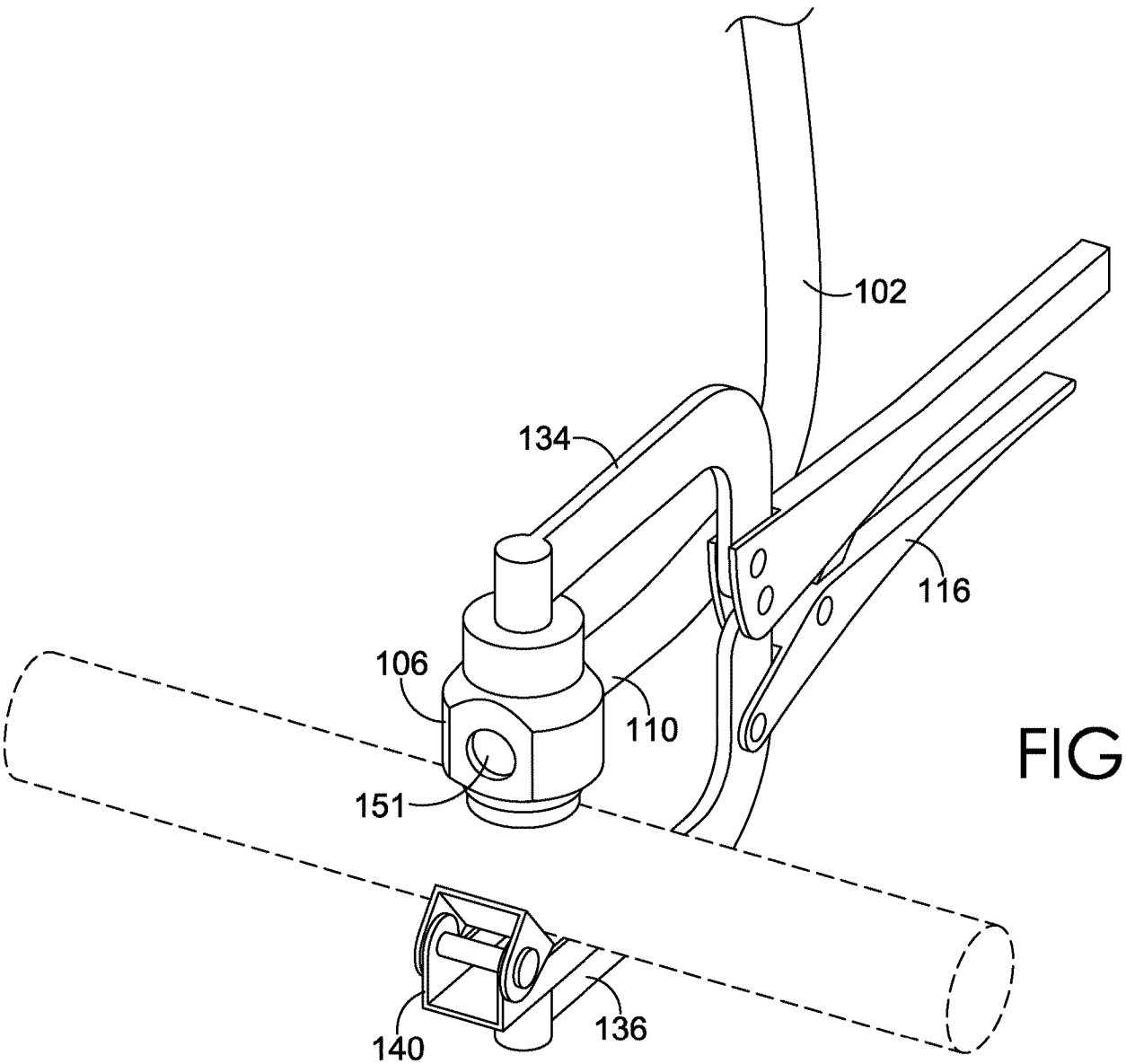
FIG. 3 is a perspective view of a clamp configured to connect a first conductive coupling to a pipe, in accordance with an embodiment of the present invention.

Referring to FIG. 3, a pipe clamp 116 configured to connect a conductive coupling to a pipe is shown, in accordance with an aspect of the present invention. The pipe clamp 116 and the magnet clamp 118 may be similar, and may in fact be the same clamp, with the stub 114 similar in size and shape to a small copper pipe to which clamp 116 may attach. In this regard, the clamps 116, 118 may be selected and designed to be interchangeable, or be of any desired size or shape, as needed. FIG. 3 shows the pipe clamp 116 with a first half 134 and a second half 136 configured to engage and secure a pipe. The first half 134 comprises the second conductive coupling 106 and the second half 136 comprises the pipe saddle 140 for grasping the pipe. The second end 110 of the electrically conductive cable 102 is shown electrically coupled to the second conductive coupling 106 which is affixed to the first half 134 of the pipe clamp 116. The second conductive coupling 106 further includes a connection point 151 for an additional cable connection.

Figure 4:
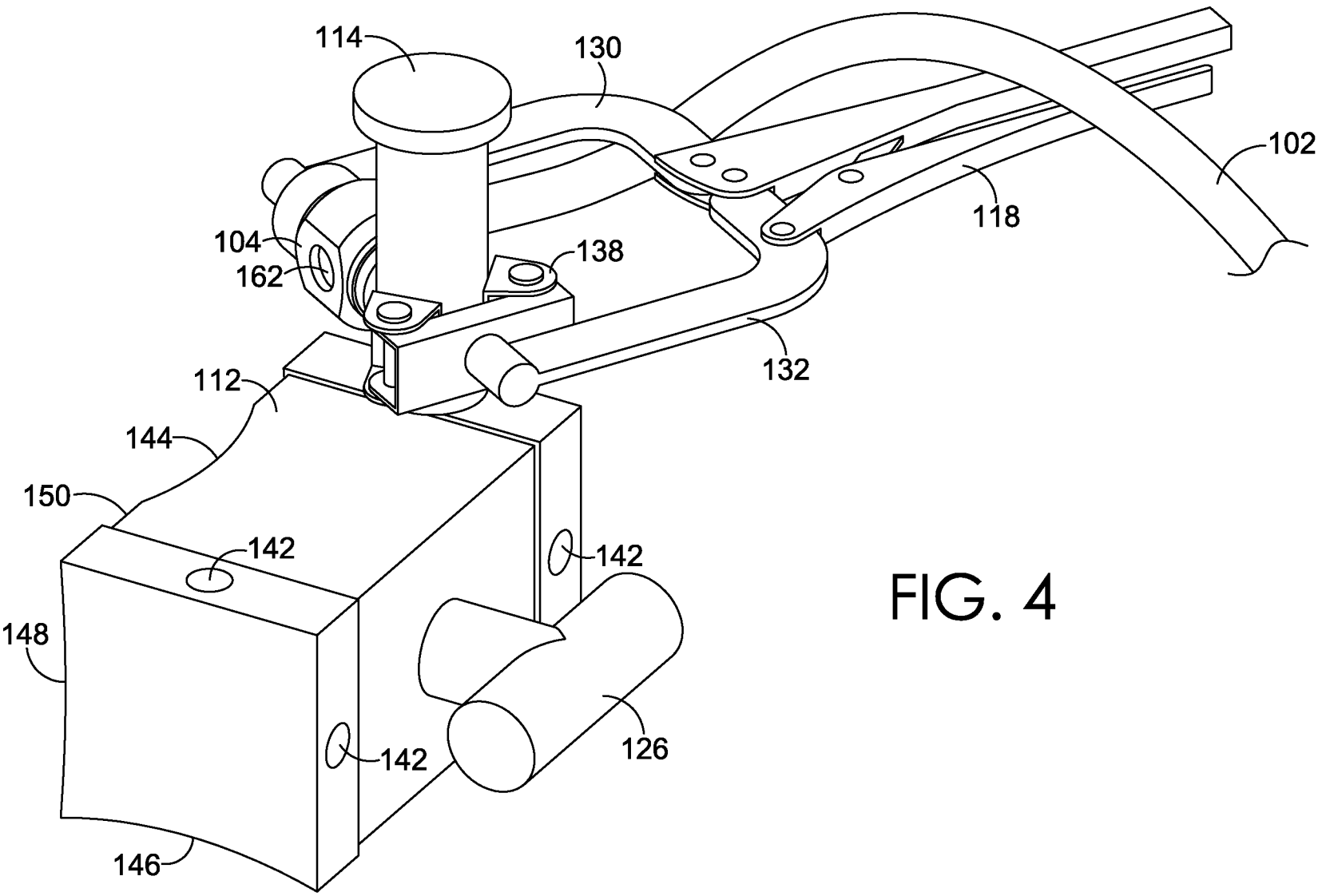
FIG. 4 is a perspective view of a clamp configured to connect a conductive coupling to a magnetic component at a conductive mount (i.e., stub), in accordance with an embodiment of the present invention.

Referring to FIG. 4, a clamp configured to connect a first conductive coupling 104 to a magnetic component 112 is shown, in accordance with an aspect of the present invention. In FIG. 4, the first magnetic component 112 comprises a stub 114 and a positioning handle 126. The magnet clamp 118 comprises a first half 130 and a second half 132. The first half 130 secures and retains the first conductive coupling 104 and the second half 132 secures and retains the stub saddle 138. The stub saddle 138 is configured to grapple a pipe and hold it against the first conductive coupling 104 when the magnet clamp 118 is closed around the pipe, providing an electrical connection between the first conductive coupling 104 and the stub 114. The magnetic component 112 further comprises multiple contours 144, 146, and 148. Each of the contours 144, 146, and 148 matches the contours of different diameter pipes or pipe diameter ranges. The first conductive coupling 104 further includes a connection point 162 for an additional cable connection. The magnetic component 112 comprises a plurality of locations 142 for mounting the stub 114.

Figure 5:
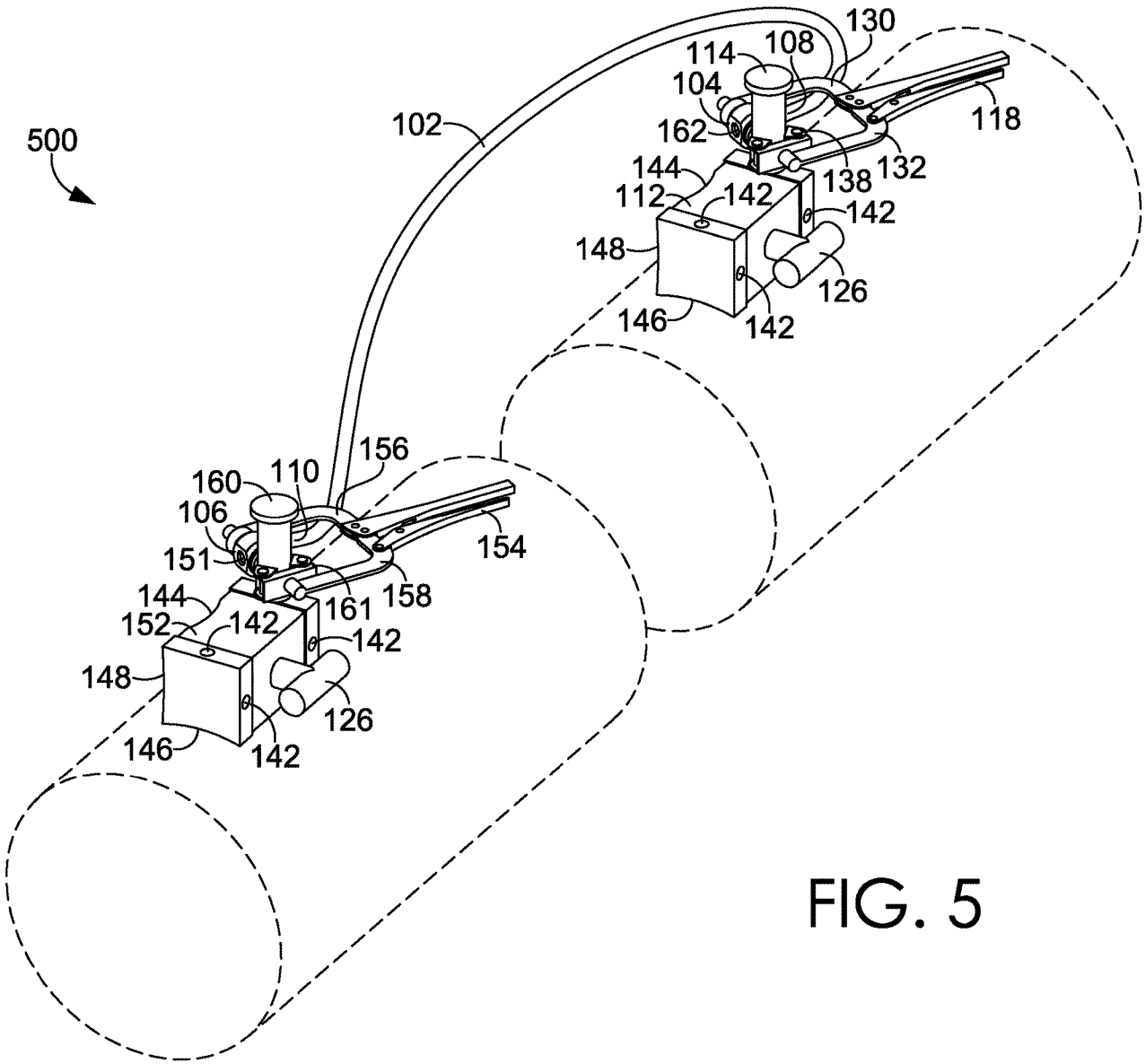
FIG. 5 is a perspective view of another temporary electrical grounding apparatus comprising two magnetic components, in accordance with an embodiment of the present invention.

Referring to FIG. 5, a second embodiment 500 of a temporary electrical grounding apparatus is shown, in accordance with an aspect of the present invention. The apparatus 500 comprises a first magnetic component 112 and a second magnetic component 152 which are shown electrically coupled to provide an electrical bypass between conductive surfaces. The magnetic components 112, 152 are coupled together using the first electrically conductive cable 102. The first magnetic component 112 comprises the elements described in FIG. 4. Additionally, the second magnetic component 152 comprises a second magnetic clamp 154 coupled to a second magnetic stub 160, the second magnetic clamp 154 comprising a first half 156 and a second half 158. The first half 156 comprises the second conductive coupling 106 having a cable connection point 151, and the second half 158 comprises the second magnetic stub saddle 161 which engages and secures the second stub 160 when the second magnet clamp 154 is closed around the stub 160. The first and second magnetic components 112, 152 may be electrically coupled to different pipes or to different sections of the same pipe when a clamp or collar is impractical, insufficient, or otherwise undesirable. The magnetic components 112, 152 further comprise a handle 126 and multiple contours 144, 146, and 148.

Figure 6:
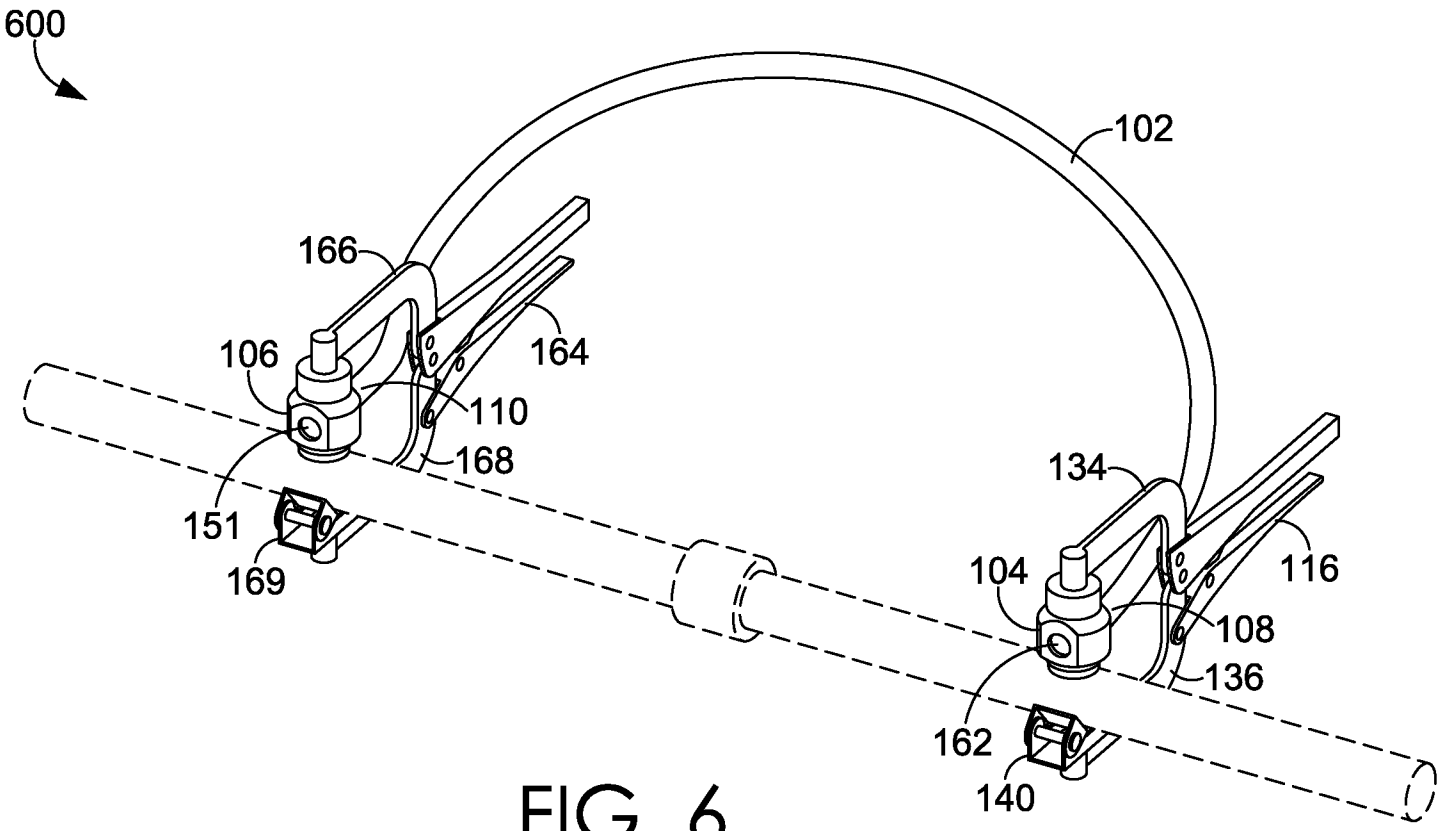
FIG. 6 is a perspective view of another temporary electrical grounding apparatus comprising two clamps, in accordance with an embodiment of the present invention.

Referring to FIG. 6, a third embodiment 600 of a temporary electrical ground apparatus is shown, in accordance with an aspect of the present invention. In FIG. 6, a first electrically conductive cable 102 comprising a first end 108 and a second end 110 is electrically coupled to a first conductive coupling 104 at the first end 108 and a second conductive coupling 106 at the second end 110. The first conductive coupling 104 is electrically coupled to a pipe clamp 116, the pipe clamp 116 comprising a first half 134 and a second half 136. The first half 134 of the pipe clamp 116 comprises the first conductive coupling 104, and the second half 136 of the pipe clamp 116 comprises the pipe saddle 140 such that when the pipe clamp 116 is closed around a pipe, the first conductive coupling 104 is electrically coupled to the pipe. The first conductive coupling 104 further comprises an additional cable connection point 162. The conductive cable 102 electrically couples the first conductive coupling 104 to a second conductive coupling 106, the second conductive coupling 106 electrically coupled to a second pipe clamp 164, the second pipe clamp 164 comprising a first half 166 and a second half 168. The first half 166 comprising the second conductive coupling 106 and the second half 168 comprising a second pipe saddle 169. The second conductive coupling 106 further comprises a connection point 151 for attaching a conductive cable. The clamps 116 and 164 are configured to engage and retain a first and second pipe or different sections of the same pipe, or different valves, surfaces, or other components.

Figure 7:
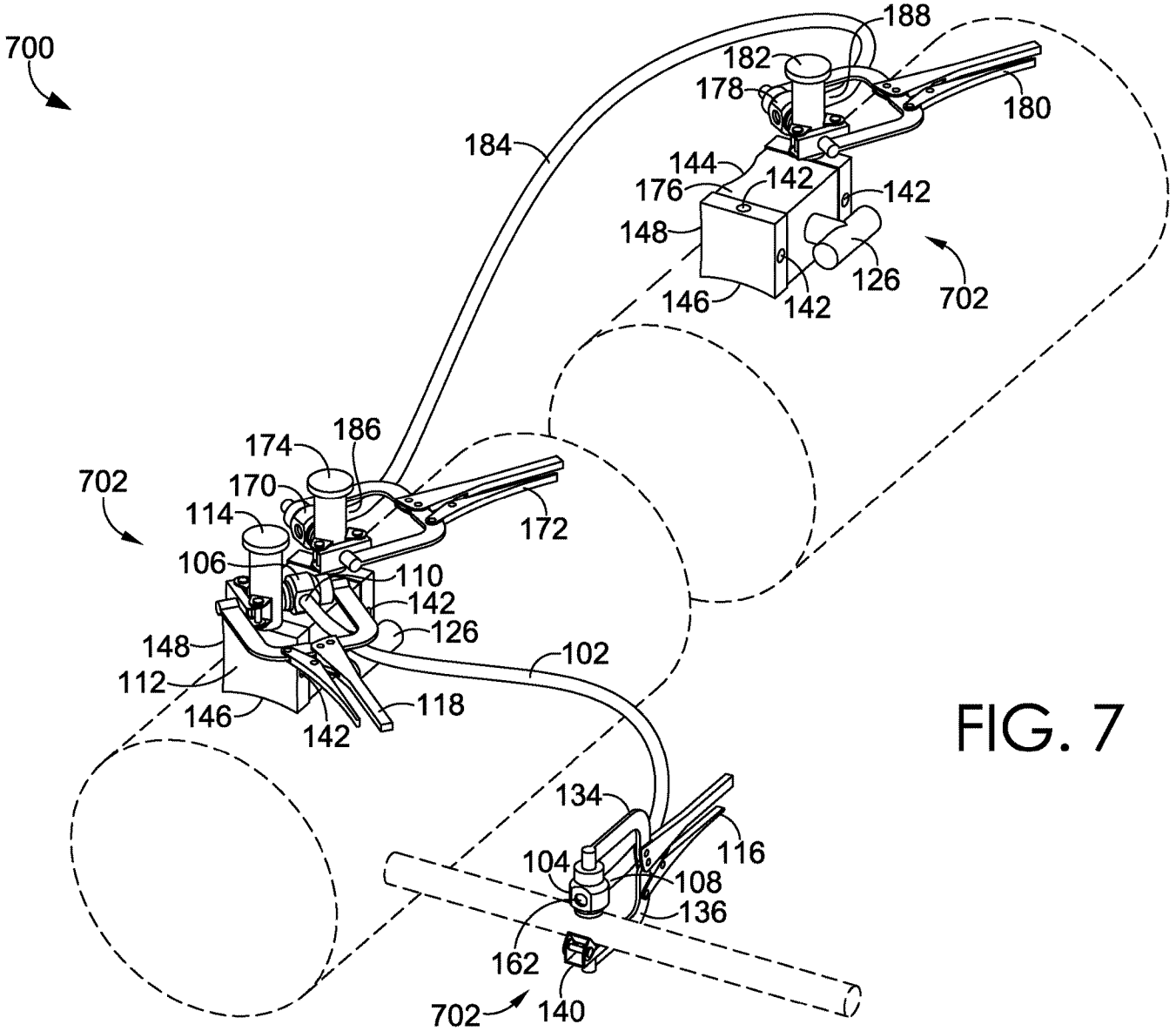
FIG. 7 is a perspective view of another temporary electrical grounding apparatus comprising multiple magnets and multiple cables, in accordance with an embodiment of the present invention.

Referring to FIG. 7, a fourth embodiment 700 of a temporary electrical grounding apparatus is shown, in accordance with an aspect of the present invention. In FIG. 7, multiple conductive elements 702 are joined to provide an electrical bypass. Any combination of clamps and magnetic components described herein can be used, and the arrangement shown in FIG. 7 is merely exemplary. FIG. 7 depicts one configuration in which a first conductive coupling 104 is coupled to a first conductive surface using a pipe clamp 116 having a first half 134 and a second half 136, the first conductive coupling 104 electrically coupled to a second conductive coupling 106 through a first electrically conductive cable 102, the second conductive coupling 106 electrically coupled to a first magnetic component 112 through a first magnet clamp 118 electrically coupled to a first stub 114 affixed to the first magnetic component 112. The first magnetic component 112 is further coupled to a second conductive surface and comprises first, second, and third contours 144, 146, and 148.

A third conductive coupling 170 is electrically coupled to the first magnetic component 112 through a third magnet clamp 172 coupled to a second stub 174 located on the first magnetic component 112. The third conductive coupling 170 is electrically coupled to a fourth conductive coupling 178 through a second electrically conductive cable 184 having a first end 186 and a second end 188. The first end 186 of the second cable 184 is electrically coupled to the third conductive coupling 170, and the second end 188 of the second cable 184 is electrically coupled to the fourth conductive coupling 178, the fourth conductive coupling 178 being located on a third magnetic component 176. The fourth conductive coupling 178 is electrically coupled to the third magnetic component 176 through a fourth magnet clamp 180 electrically coupled to a third stub 182 affixed to the third magnetic component 176. The third magnetic component 176 is electrically coupled to a third conductive surface, so that the device provides a current path between the first, second, and third conductive surfaces.

Figure 8:
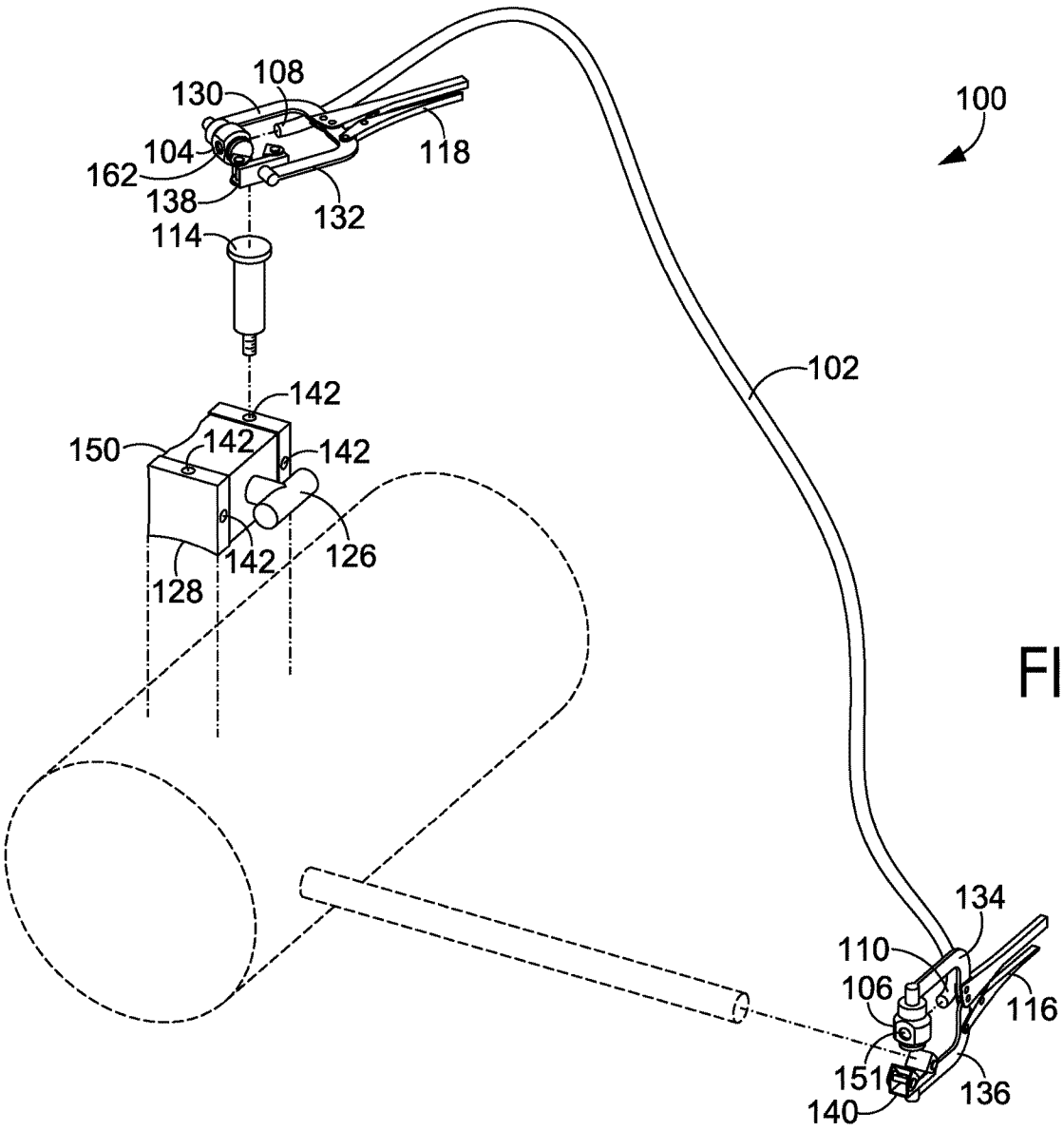
FIG. 8 is an exploded view of the temporary electrical grounding apparatus presented in FIG. 1, in accordance with an embodiment of the present invention.

Referring to FIG. 8, an exploded view of the first embodiment 100 depicted in FIG. 1 is shown, in accordance with an aspect of the present invention. As with FIG. 1, a first electrically conductive cable 102 having a first end 108 and a second end 110 is electrically coupled to a first conductive coupling 104 at the first end 108 and a second conductive coupling 106 at a second end 110. The first conductive coupling 104 is electrically coupled to a first magnetic component 112 using a magnet clamp 118 secured to a conductive mount 114 (i.e., a stub 114), the stub 114 being positioned on the first magnetic component 112 at one of a plurality of locations 142.

The magnet clamp 118 further comprises a first half 130 and a second half 132 which are brought together when the magnet clamp 118 is closed to electrically couple and secure the magnet clamp 118 to the stub 114. The first half 130 of the magnet clamp 118 retains the first conductive coupling 104, and the second half 132 of the magnetic clamp 118 retains a saddle 138, which work together to engage and retain the stub 114 when the magnet clamp 118 is closed around a pipe or similar object. The first magnetic component 112 includes a curved contour 128 that matches the curved contour of the pipe. The second conductive coupling 106 comprises a pipe clamp 116, the pipe clamp 116 comprising a first half 134 and a second half 136. The first half 134 of the pipe clamp 116 secures the second conductive coupling 106 to the pipe clamp 116 and the second half 136 of the pipe clamp 116 secures a pipe saddle 140 to the pipe clamp 116. When the pipe clamp 116 is closed, the first and second halves 134, 136 join together to engage and secure the pipe, providing an electrical connection between the second conductive coupling 106 and the pipe.

Figure 9:
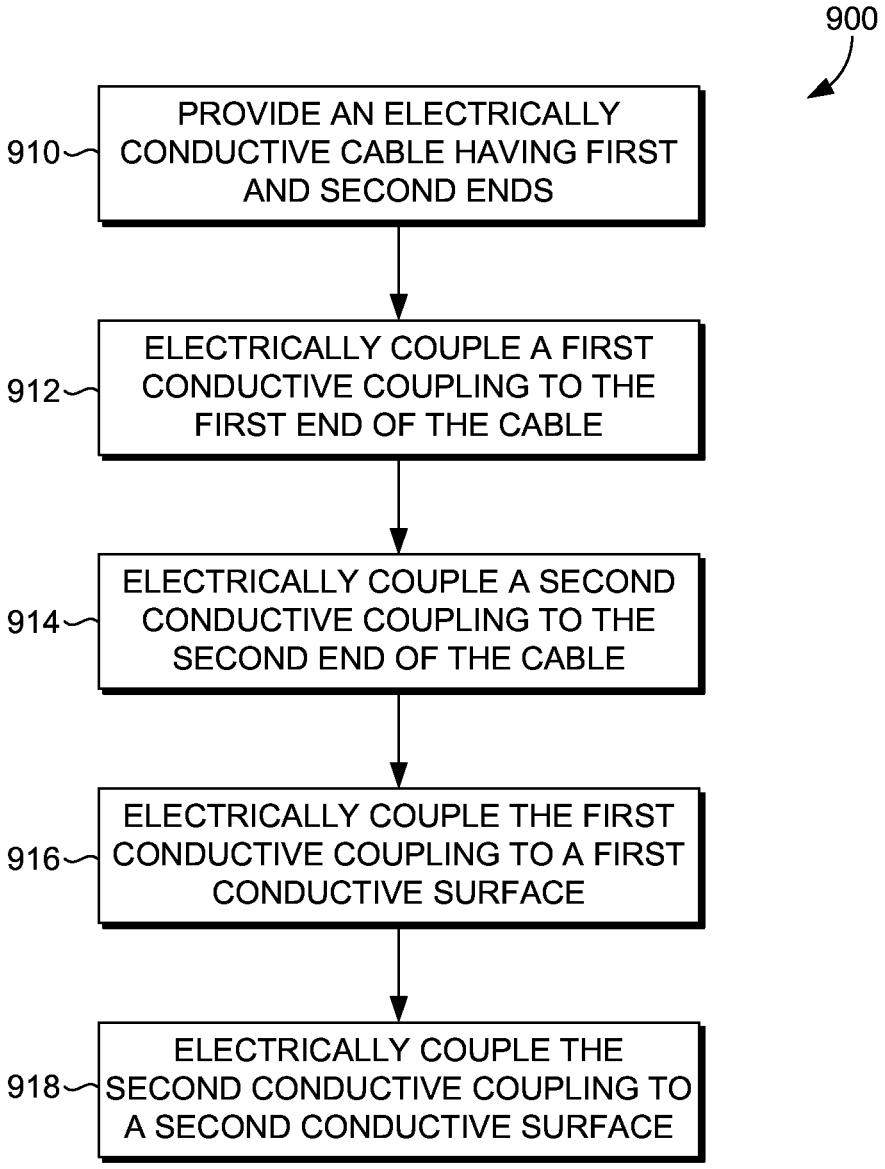
FIG. 9 is a block diagram of a method for assembling a temporary electrical grounding apparatus, in accordance with an embodiment of the present invention.

Referring to FIG. 9, a block diagram of an exemplary method 900 for providing a temporary electrical grounding connection is shown, in accordance with an aspect of the present invention. At a first block 910, an electrically conductive cable, such as the cable 102 shown in FIG. 1, having first and second ends, such as the first and second ends 108, 110 shown in FIG. 1, is provided. At a second block 912, a first conductive coupling, such as the first conductive coupling 104 shown in FIG. 1, is electrically coupled to the first end of the cable. At a third block 914, a second conductive coupling, such as the second conductive coupling 106 shown in FIG. 1, is electrically coupled to the second end of the cable. At a fourth block 916, the first conductive coupling is electrically coupled to a first conductive surface. At a fifth block 918, the second conductive coupling is electrically coupled to a second conductive surface.

Embodiments of the technology have been described to be illustrative rather than restrictive. Alternative embodiments will become apparent to readers of this disclosure. Further, alternative means of implementing the aforementioned elements and steps can be used without departing from the scope of the claims below, as would be understood by one having ordinary skill in the art. Certain features and subcombinations are of utility and may be employed without reference to other features and subcombinations, and are contemplated as within the scope of the claims.

The invention claimed is:

1. A method of manufacturing a temporary electrical grounding device, the method comprising:

providing a first conductive coupling configured to electrically engage a first conductive surface;

providing a second conductive coupling configured to electrically engage a second conductive surface;

providing an electrically conductive cable having first and second ends;

attaching the first conductive coupling to the first end of the electrically conductive cable;

attaching the second conductive coupling to the second end of the electrically conductive cable;

providing a magnetic component having a plurality of contours;

selecting one contour of the plurality of contours, the one contour configured to electrically and magnetically engage a contour of the first conductive surface;

coupling the magnetic component to the first conductive coupling; and coupling the one contour of the magnetic component to the first conductive surface.

2. The method of claim 1, wherein at least one of the first and the second conductive couplings comprises a clamp.

3. The method of claim 1, wherein the plurality of contours includes at least one curved contour.

4. The method of claim 1, wherein the magnetic component includes a conductive mount coupled thereto.

5. The method of claim 4, wherein the conductive mount is selectively attachable at any one of a plurality of different locations on the magnetic component.

6. The method of claim 1, wherein at least one of the electrically conductive cable, the first conductive coupling, the second conductive coupling, and the magnetic component is electrically insulated.

7. The method of claim 1, further comprising:

providing a second magnetic component having a plurality of contours;

selecting one contour of the plurality of contours, the one contour configured to electrically and magnetically engage a contour of the second conductive surface;

coupling the second magnetic component to the second conductive coupling; and coupling the one contour of the second magnetic component to the second conductive surface.

8. A method of providing a temporary electrical bypass, the method comprising:

using a device comprising:

(1) an electrically conductive cable having first and second ends, (2) a first conductive coupling attached to the first end and configured to electrically couple to a magnetic component including a plurality of contours, one contour configured to electrically and magnetically engage a first conductive surface, and (3) a second conductive coupling attached to the second end and configured to couple to a second conductive surface, electrically and magnetically coupling the one contour of the magnetic component to the first conductive surface; and electrically coupling the second conductive coupling to the second conductive surface to provide an electrical bypass between the first conductive surface and the second conductive surface.

9. The method of claim 8, wherein at least one of the first conductive coupling and the second conductive coupling further comprises a clamp.

10. The method of claim 8, wherein the plurality of contours includes one or more curved contours.

11. A method for providing an electrical grounding connection, the method comprising:

providing an electrically conductive cable having first and second ends;

electrically coupling a first conductive coupling to the first end of the cable;

electrically coupling a second conductive coupling to the second end of the cable;

electrically coupling the first conductive coupling to a magnetic component including a plurality of contours, one contour configured to electrically and magnetically engage a first conductive surface; and electrically coupling the second conductive coupling to a second conductive surface.

12. The method of claim 11, wherein the second conductive coupling is electrically coupled to a second magnetic component including a plurality of contours, one contour configured to electrically and magnetically engage the second conductive surface.

13. The method of claim 11, wherein the second conductive coupling is electrically coupled to a clamp configured to engage a pipe.

* * * * *